United States Patent [19]

Saetti

[11] 4,407,209

[45] Oct. 4, 1983

[54] WORKPIECE FOLDING GUIDE FOR CUTTING AND SEWING MACHINES

[75] Inventor: Giuseppe Saetti, Costermano, Italy

[73] Assignee: Rockwell International Corporation, Pittsburgh, Pa.

[21] Appl. No.: 296,685

[22] Filed: Aug. 27, 1981

[30] Foreign Application Priority Data

Sep. 5, 1980 [IT] Italy ..... 40069 A/80

[51] Int. Cl.[3] ..... D05B 35/04

[52] U.S. Cl. ..... 112/147

[58] Field of Search ..... 112/137, 141, 147; 270/40–43; 223/34

[56] References Cited

U.S. PATENT DOCUMENTS 2,518,340 8/1950 Levine et al. ..... 112/147 X 3,710,742 1/1973 Chercass ..... 112/147 X 4,095,538 6/1978 Rockerath et al. ..... 112/147

*Primary Examiner*—Werner H. Schroeder

*Assistant Examiner*—Andrew M. Falik

[57] ABSTRACT

A folding guide for cutting and sewing machine workpieces formed from knit fabric for effecting folds therein prior to being sewn and cut having first and second plate elements disposed in vertically spaced and parallel alignment. A third plate element extending parallel to the first and second plate elements has an edge disposed intermediate the latter plate elements at an angle oblique thereto and with a pressing apparatus operatively associated with the third plate element for pressing the workpiece into contact therewith which prevents its displacement and permits folding of the workpiece that is being constrained by the edge of the third plate element as the workpiece is being advanced through the guide.

4 Claims, 5 Drawing Figures

1
2
3
4
5
6
7
8
9
10
11
12
13
14
15
16
17
21
23

WORKPIECE FOLDING GUIDE FOR CUTTING AND SEWING MACHINES

BACKGROUND OF THE INVENTION

The invention pertains to a folding guide for use with cutting and sewing machines and more particularly, a guide for effecting folds in workpieces formed from knit fabric prior to their being subjected to the cutting and sewing operations.

In the knitted garment industry, it is common practice to cut knit fabric into flat straight pieces and then shape them into workpieces which will subsequently form a finished article such as sleeves having a forward portion and a rearward portion. The edges of such workpieces are subject to fraying as a result of cutting and it is necessary that such edges be folded onto themselves and then sewn so as to form an acceptable edge on the finished article of clothing. These acceptable edges are formed by sewing and cutting machines in which the folded edge is sewn and thence severed from that portion not required by the finished article.

To avoid manual folding of such edges, apparatuses are known which utilize a conveyor for supporting the articles to be folded which presents the articles to a folding guide that automatically and effectively folds the edges and then advances the latter to the sewing and cutting machine. These known apparatuses have a very definite disadvantage in that they are not capable of effecting a fold of a width greater than 2–2.5 cm. The reason for this disadvantage is that any attempt to increase the width of a fold, the known guides are not capable of maintaining parallelism between the edges itself thus causing an unacceptable sewing and cutting operation to be performed. Additionally, attempts at very wide folds induces bagging of the fabric which obviously would be responsible for defects in the finished article.

An object of the present invention is to eliminate the disadvantages described above, by providing a folding guide that is capable of effectively and satisfactorily forming folded edges of substantially greater width than has been heretofore possible with the known forms of folding guides. A further object is to provide a folding guide of simplified construction, economical to manufacture, with long life expectancy and which can be readily adapted for use with existing sewing and cutting machines.

The folding guide according to the invention includes first and second plate elements extending in parallel relationship and vertically spaced one from the other. A third plate element also extends in parallel relation to the first and second plate elements and includes an edge disposed between and at an angle oblique to the latter. The folding guide is disposed upstream of a sewing and cutting machine and slightly above a conveyor so that as the edges of the fabric to be folded are advanced by the conveyor, they are caused to pass below the first plate element and above the third plate element that is provided with a pressing device operatively associated with its upper surface to effect an increase in the frictional force with which the fabric engages this upper surface and in combination with the angularly disposed edge of the third plate element is effective in forming the desired fold in the workpiece.

These and other objects of the present invention will become more fully apparent by reference to the appended claims and as the following detailed description proceeds in reference to the figures of drawing wherein:

DESCRIPTION OF THE PREFERRED EMBODIMENT

Figure 1:
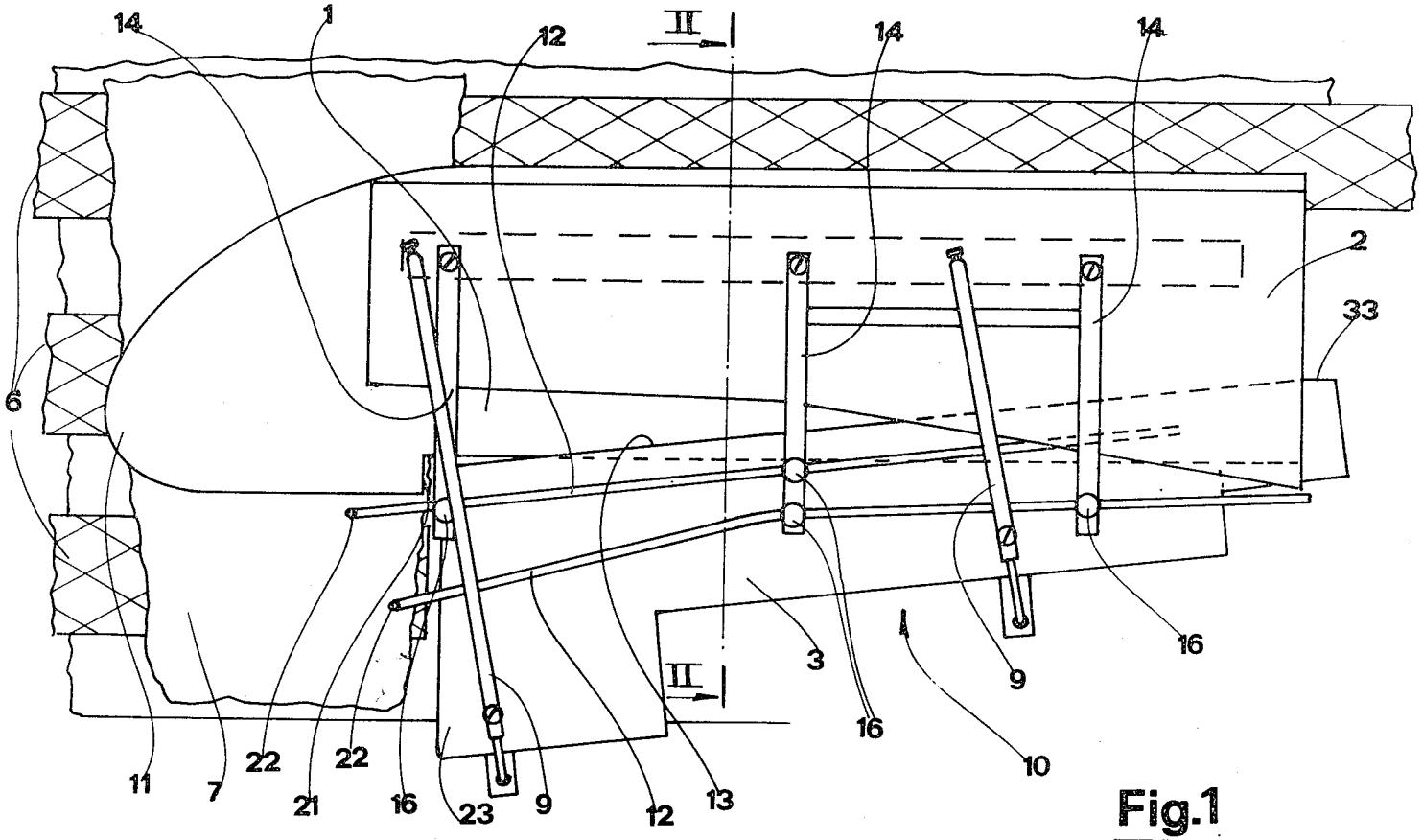
FIG. 1 is a top view of the workpiece folding guide according to the invention.
Figures 2, 3:
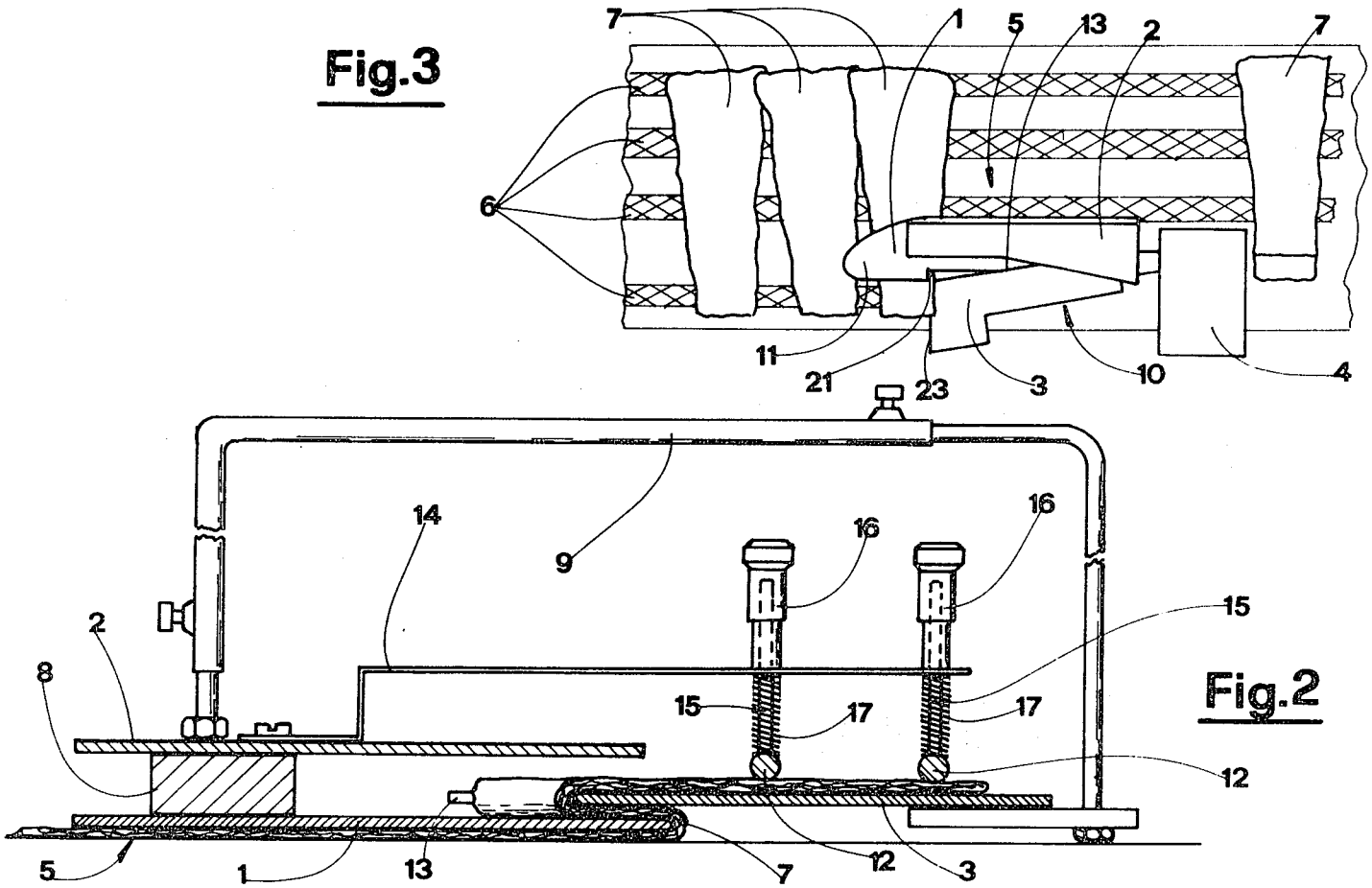
FIG. 2 is a sectional view as seen looking in the direction of the indicating arrows of line II—II in FIG. 1.
FIG. 3 is a view similar to FIG. 1 but showing the guide's association with the sewing and cutting machine as well as the workpieces.
Figure 4:
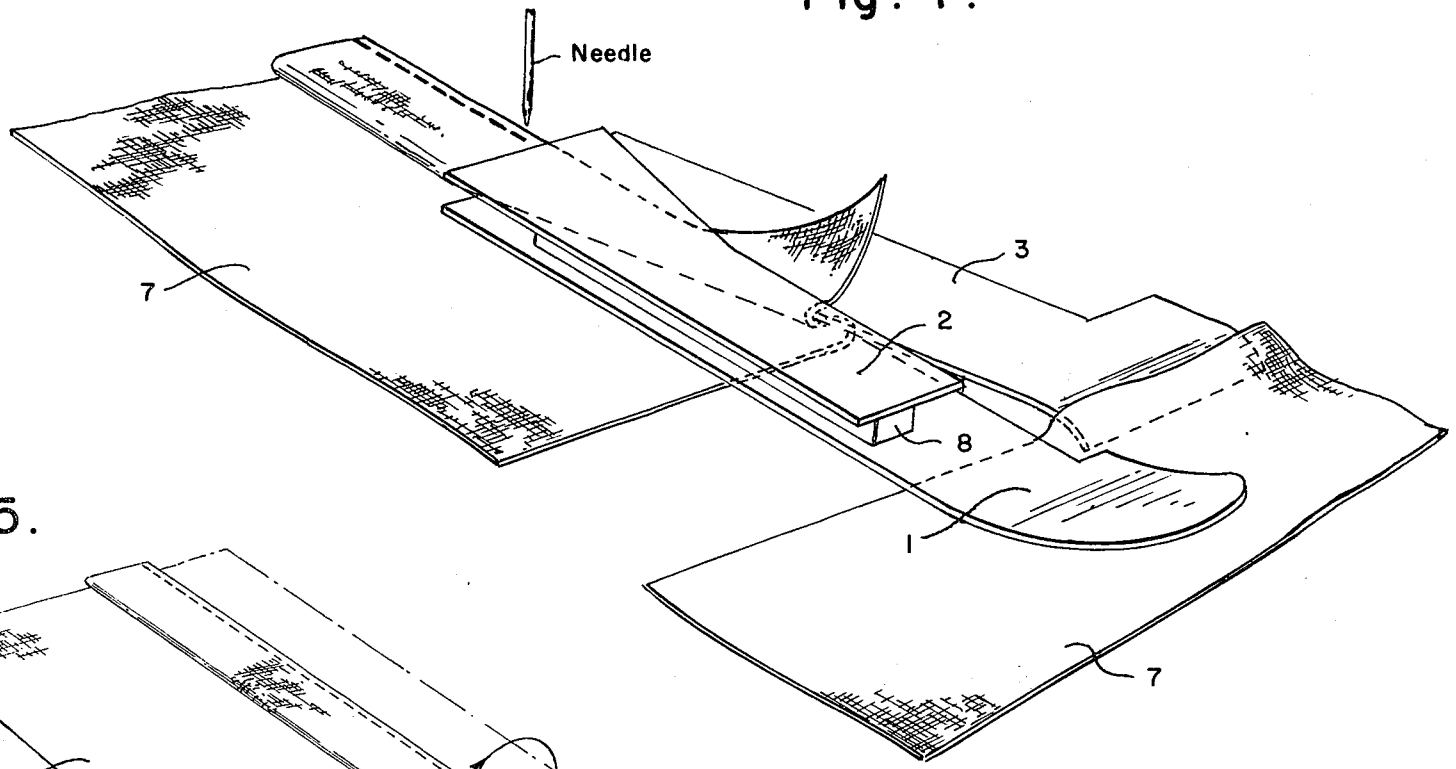
FIG. 4 is a perspective view of the workpiece folding guide showing the manner in which the fold is formed.
Figure 5:
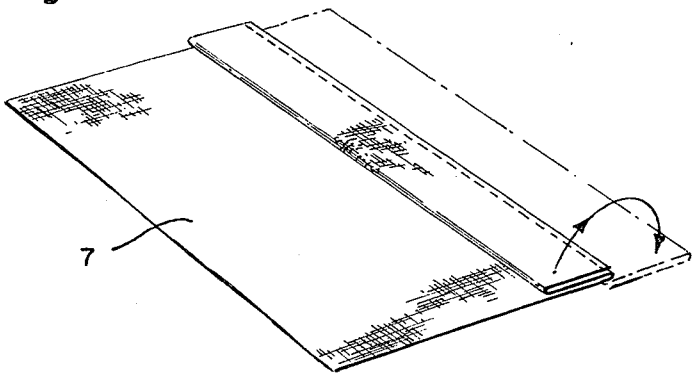
FIG. 5 is a perspective view of the folded workpiece.

The folding guide according to the invention is identified generally in FIGS. 1 and 3 by numeral 10, and as shown in FIG. 3 is located upstream of a sewing and cutting machine 4. A conveyor 5 is disposed below and in operative association with the folding guide 10 and includes a plurality of driven tapes 6 which are adapted to support workpieces 7 and advance the same to said folding guide 10 and thence to the sewing and cutting machine 4.

The folding guide 10 includes a first plate element 1 and a second plate element 2 which extend in parallel relation and being disposed one above the other are separated by a spacer 8 interposed therebetween. The plate elements 1 and 2 are firmly interconnected and are fixedly positioned with respect to the conveyor 5. The plate 1 is disposed above and in close proximity with the conveyor 5 and is provided with a leading end 11 that is curved upwardly which serves to facilitate the insertion of the workpieces 7 beneath said plate 1. The folding guide 10 is also provided with a third plate element 3 which extends parallel with plates 1 and 2 and includes an edge 13 that is located between said plates 1 and 2 and which extends at an angle oblique to the direction at which the latter extend. The forward end of plate element 3 is depicted by numeral 23 and is curved downwardly to a position of operative association with one of the tapes 6 which is effective in causing the workpieces to enter the guide above said plate element 3. To effect the desired cooperation of the workpiece 7 with the plate element 3, the corner forming the connection between the end 23 and the edge 13 is disposed relative to the movement of the tapes 6, behind a notch 21 formed in the first plate element 1.

To facilitate correct sewing and cutting of the folded fabric, the trailing end of the edge 13 which is depicted by numeral 33, extends in a direction substantially parallel to the sewing axis and the direction of movement of the tapes 6. The plate element 3 is supported by telescopic members 9 which are connected to the first and second plate elements with the length thereof being adjustable in the direction of insertion of the third plate between said first and second plates whereby a means is provided for selectively locating the edge 13 at the most appropriate locational depth between the plate elements 1 and 2. The folding guide 10 also includes a pressing device disposed in operative association with the third plate element 3 and serves to increase the frictional contact with which a workpiece is caused to engage the upper surface of this plate element. The pressing device includes a pair of elongated bar members 12 that are biased in the direction of the upper surface of the plate element 3 and extend in a direction substantially parallel to the direction of movement of the tapes 6. Additionally, these bar members 12 are supported by bracket members 14 which as shown in FIG. 2 are assembled to the upper surface of the second plate element 2.

Threaded pins 15 serve to interconnect the bar members 12 with the bracket members 14 by having one end thereof fixedly attached to said bar members and extending upwardly therefrom the threaded portions extend through aligned openings in the bracket members 14 and their upper ends each have a nut 16 assembled thereon. A coil spring 17 assembles on each of the threaded pins intermediate the bar members 12 and the underside of the bracket members 14.

The combination of the threaded pins 15, nuts 16 and coil springs 17 define a regulating device whereby the biasing force which the bar members apply to the workpiece 7 located intermediate the latter and the third plate element 3, can be selectively increased or decreased as desired. Additionally, to facilitate insertion of a workpiece 7 beneath the bar members 12 and onto the third plate element 3, the forward ends of said bar members are curved upwardly.

To summarize the operation, the workpieces 7 are advanced by the tapes 6 of the conveyor 5 and as each meets the upwardly curved leading end 11 of the first plate element 1, it is caused to pass beneath the latter and when it engages the downwardly curved end 23 of the third plate element 3, it advances over the upper surface of the latter. That portion of the workpiece which engages the upper surface of the third plate element 3 is pressed into frictional contact therewith by the bar members 12.

The workpieces 7 are moved forwardly by the tapes 6 and the first plate element 1 with which they are in contact as they are advanced through the guide serves to maintain said workpieces in their correct position relative to said tapes 6.

Those portions of the workpieces which move across the upper surface of the plate element 3 are constrained by the latter's edge 13 and being angularly disposed as heretofore described provides the means for effecting the desired folding of the workpieces as they are advanced through the guide. At the exit end of the folding guide 10, that portion of the workpiece 7 which engaged the upper surface of the third plate element 3 is folded over that portion engaged by the first plate element 1 and in its folded state is presented to the sewing and cutting machine 4 where the folds are sewn and the excess material severed from said workpiece.

The width of the fold formed on a workpiece can be selectively regulated by increasing or decreasing the length of the telescopic members 9 as desired and selectively locating the position of the edge 13 of the third plate element 3 beneath the first and second plate elements 1 and 2.

When attempting to form a fold of a width greater than 2 cm. in the known types of folding guides, that portion of the workpiece in contact with the upper surface of the intermediate plate element tends to slip and fails to follow the angularly disposed edge of this plate element. Such a condition is attributed to the fact that to obtain a fold of considerable width with these guides while maintaining the length of the latter within reasonable limits, it is necessary that the edge of the intermediate plate element be disposed at a substantial angle relative to the direction of movement of the conveyor's tapes.

Unlike the known types of folding guides, the one according to the invention is provided with a pressing device in operative association with the upper surface of the third plate element 3 and is effective in preventing slippage of a workpiece that causes irregular and undesirable fold formation. The bar members 12 defining the pressing device serve to prevent a bagging condition from developing as the workpiece engages the third plate element 3 and also the notch 21 on the first plate element 1 serves to prevent the occurence of such a bagging condition. Relative to the thickness of a workpiece, when considering its roughness and consistency, it is possible by means of the nuts 16 to selectively control the closeness of the bar members 12 to the upper surface of the third plate element 3 and the pressure with which they are caused to engage the workpiece.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A workpiece folding guide for receiving workpieces from a conveyor and presenting them in a folded condition to a sewing and cutting machine, said workpiece folding guide comprising:

(a) a first plate element operatively connected to the conveyor for receiving a workpiece thereunder from said conveyor;

(b) a second plate element extending parallel with and connected in vertically spaced relation to said first plate element;

(c) a third plate element (3) connected to said first and second plate elements and supported to extend parallel with and between the latter including:

(i) telescopic members (9) connected to said first and second plate elements for selectively changing its operating position between the latter;

(ii) an edge extending at an angle oblique to the direction of movement of a workpiece through the guide; and (d) means operatively associated with the upper surface of said third plate element (3) for pressing a workpiece into frictional contact therewith during advance and the folding of the workpiece within said folding guide.

2. The workpiece folding guide according to claim 1 wherein said pressing means define a pair of spaced elongated bar members (12) extending substantially parallel to the direction of advance of a workpiece on the conveyor.

3. The workpiece folding guide according to claim 2 wherein said bar members are supported by threaded pins (15) having coil springs (17) assembled thereon for continually urging said bar members in the direction of the upper surface of said third plate element.

4. The workpiece folding guide according to claim 3 wherein said threaded pins include means for selectively changing the biasing force of said springs to obtain the most suitable pressing force by said bar members on a particular type of workpiece.

* * * * *